United States Patent [19]

Poldervaart et al.

[11] Patent Number: 4,476,802

[45] Date of Patent: Oct. 16, 1984

[54] ANCHOR

[75] Inventors: Leendert Poldervaart, La Turbie, France; John Cuckson, Monaco, Monaco

[73] Assignee: Single Buoy Moorings, Inc., Marly, Switzerland

[21] Appl. No.: 495,609

[22] Filed: May 18, 1983

[30] Foreign Application Priority Data

May 17, 1982 [NL] Netherlands ..... 8202026

[51] Int. Cl.[3] ..... B63B 21/27

[52] U.S. Cl. ..... 114/296; 114/294; 405/224

[58] Field of Search ..... 114/294, 295, 296, 297, 114/311, 266, 230, 264; 52/166, 699; 405/224; 441/5

[56] References Cited

U.S. PATENT DOCUMENTS

| | | | |
|---|---|---|---|
| 3,051,117 | 8/1962 | Hunter | 114/296 |
| 3,263,641 | 8/1966 | Stimson | 405/224 |
| 3,520,543 | 7/1970 | Etter et al. | 114/296 |
| 3,682,125 | 8/1972 | Stevens | 114/296 |
| 3,708,985 | 1/1973 | Rogonowski | 114/264 |
| 3,961,490 | 6/1976 | Corgnet | 114/230 |
| 4,048,944 | 9/1977 | Corgnet | 114/296 |
| 4,270,480 | 6/1981 | Hancock | 114/296 |

FOREIGN PATENT DOCUMENTS

| | | |
|---|---|---|
| 1595727 | 6/1970 | France . |
| 2247377 | 5/1975 | France . |
| 7414432 | 5/1976 | Netherlands . |

*Primary Examiner*—Trygve M. Blix
*Assistant Examiner*—Patrick W. Young
*Attorney, Agent, or Firm*—Young & Thompson

[57] ABSTRACT

Anchor for connecting or attaching a buoyant device that exerts an upward force on an anchor. The anchor comprises a base body which is positioned on the bottom and is maintained in that position by its own weight and/or auxiliary means, which base body has guiding elements for a second body to which that upward force is applied. The coupling between both bodies comprises a chamber bounded by both bodies which chamber can be connected to a source of underpressure.

4 Claims, 5 Drawing Figures

ANCHOR

The invention relates to an anchor for attaching or connecting device having a buoyancy resulting in an upwardly directed force component being exerted on the anchor, which force is applied to a part which is maintained in position by means of underpressure.

Such an anchor is known from the U.S. Pat. No. 4,029,039. In this known device, functioning with underpressure, the anchor in fact consists of one single body to which the upwardly directed force is applied, which body has at the underside a cavity which is closed by the bottom after positioning the anchor on the bottom. In said cavity an underpressure can be created to hold the body more strongly to the bottom than by its own weight alone. There are many other publications describing these so-called suction anchors, however they all are based on the principle that the anchor body is drawn onto the bottom by means of the underpressure.

Therefore all suction anchors have the disadvantage that their operation is dependent on the quality of a fluid tight seal between the bottom and the cavity in the anchor body in which the underpressure should be created. The bottom is however in many cases porous, so that the influence of the underpressure is impaired by penetrating water. Therefore in these prior art suction anchors, which should be kept in position during a relatively long period, the weight of the anchor plays always a dominating role. In emergency situations however, for instance when a floating island construction or a mooring system is threatened by an iceberg and therefore should be removed immediately, time consuming problems are encountered when loosening the anchor and similar problems are of course encountered when the original anchoring situation is to be restored.

An object of the invention is now to provide in a very simple way a solution for this problem.

According to the invention the anchor now comprises a base body, positioned on the bottom and maintained in that position by means of its own weight and/or auxiliary means, which base body has guiding means for a second body to which the above mentioned force is applied, whereby the coupling between both bodies consists of a chamber bounded by both bodies, which chamber can be connected to a source of underpressure.

According to the invention therefore the anchor is divided into two parts, one of which permanently rests on the sea bottom or is attached to the sea bottom, for instance by poles driven into the ground, whereas the other part is guided on said first part and can be coupled therewith under the influence of the underpressure. The result thereof is that not only the underpressure coupling has a permanent character, but also that decoupling is very simple and the part of the anchor to be elevated has a manageable weight. Now a mooring system can comprise a column having buoyancy capacity in the upper end thereof and a thereto connected tanker, which column for instance has a universal joint connection to the anchor and by removing the underpressure the whole system can be sailed away immediately. In general fluid conduits run along such a column or through such a column, which conduits may comprise automatic coupling elements near the universal anchor joint closing the conduits automatically when the connection is broken and automatically opening said conduits when the connection is restored. It is very easy to restore the anchoring position by sailing backwards and bringing the lower end of the column into the correct position above the fixed anchor part for instance using underwater cameras and lowering the column until the guiding elements cooperate, after which the coupling is restored again by generating the underpressure.

Eventually it is possible to activate a normal locking device after the coupling is realized by means of the underpressure, whereafter the underpressure can be released. Such a normal locking device is however less suitable for quick coupling, even if it is remote controlled, because the upward force acting on the anchor is also applied to the locking device eventually preventing the decoupling thereof. The forces applied to said locking devices can be reduced to zero if the underpressure is generated again and thereafter said locking device can be decoupled.

According to the invention the base body may have a space which is open at the upper side in which space the second body is axially movably guided and sealed off against the first body. Said space can for instance be a cylindrical space into which the second body can move in the same way as a piston, which second body is coupled to an anchor line or other anchoring means. Said upwardly open cylindrical space has a double function, namely a guding function and a coupling function in cooperation with the underpressure.

It is also conceivable to use separate guiding means for instance in the form of upwardly extending guiding pins on the first body. The second body is thereby sealed against the first body by means of a sealing ridge between the guiding elements such that an underpressure chamber is created between the first and second body. That implies essentially that the first body has a smooth upper surface between the guiding pins and the second body has a smooth lower surface between which smooth surfaces a ring shaped sealing ridge is positioned connected to the one or the other body. As soon as the sealing is effected because the sealing ridge is clamped between both bodies, it is possible to obtain the coupling by generating the underpressure. This type of coupling has the advantage that the second body can be embodied as a suction cup, the sucking force of which is applied to the first body.

A very simple embodiment is according to the invention obtained when the second body comprises a closed hollow space which is connected through some kind of valve means to the space bounded by both bodies. Said hollow space can, as long as it is above the water level, be filled with air under atmospheric pressure and thereafter be closed. If the second body is now submerged and moved in the direction of the first body such, that the space bounded between both bodies is created, then said space will be filled with water. If the valve means between the air filled hollow space and said water containing space between both bodies is opened, then immediately water will flow into said air filled space, because the air pressure is significantly lower than the water pressure at the same depth. In this way the connection between both bodies is established automatically without the necessity to supply additional energy.

The invention will now be explained in more detail with reference to the drawings.

Figure 1:
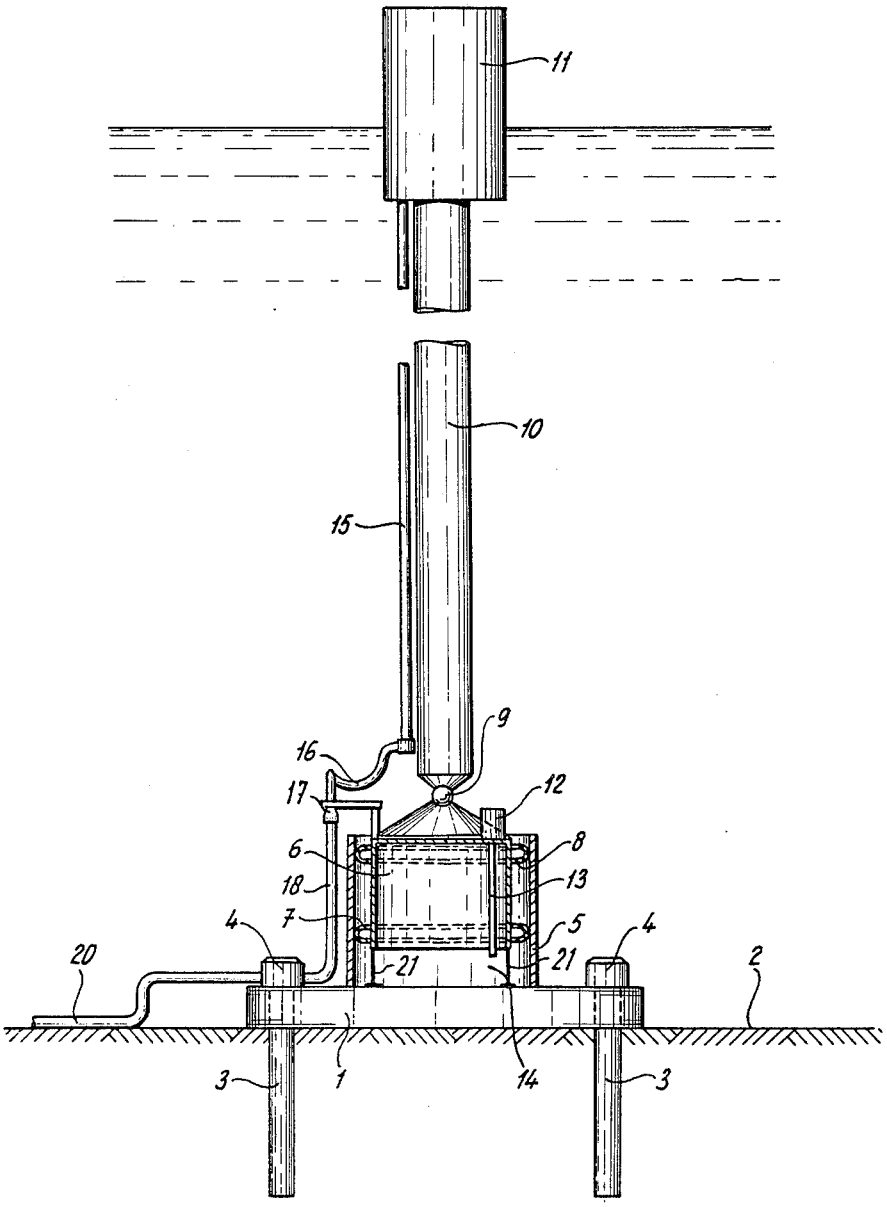
FIG. 1 illustrates schematically a possible embodiment of the anchor according to the invention.

The anchor illustrated in FIG. 1 comprises a body 1 positioned on the sea bottom 2 and maintained in that position by means of the piles 3 having the larger heads 4.

Said body 1 has a cylindrical casing 5 into which the second body 6 is inserted, which second body is embodied as a cylindrical body having a sealing ridge 7 and a guiding or a sealing ridge 8.

Said body 6 is through a universal joint 9 coupled to a column 10, of which the upper end comprises a buoyant body 11, such that the column tries to maintain a vertical position. Said buoyant body may also be positioned below the water level. The reference number 12 indicates a pump on the second body 6 by means of which through the channel 13 water can be pumped out of the space 14, creating an underpressure in said space and establishing the coupling between the parts 1 and 6. It will be clear that when the underpressure is relieved, which is very easily done by means of opening a remotely controlled valve, the second body 6 with the thereto connected column 10 and further means or systems connected to said column can be sailed away immediately. It is very easy to reestablish the connection thereafter.

Because in general conduits will run through or along the column 10, connected to conduits which are positioned on the sea bottom, it is preferred that at greater depth the coupling and decoupling of said conduits is carried out automatically. That can be realized in a very simple way using prior art means. In the figures schematically one conduit 15 is indicated bridging the universal joint 9 by means of the flexible tube 16 and connected through the coupling 17 to a conduit 18 alongside the casing 5, which conduit 18 is connected to the conduit 20. The coupling 17 can be embodied as an automatic remotely controlled automatic coupling. The reference number 21 indicates a stop element.

Figure 2:
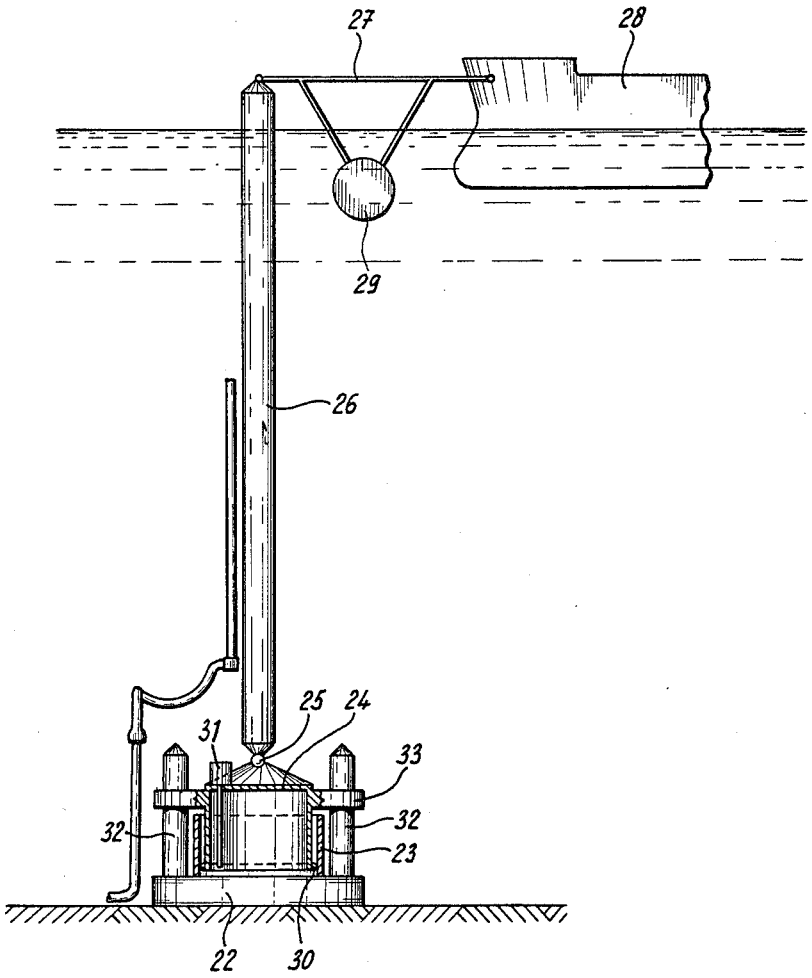
FIG. 2 illustrates schematically another embodiment.

The anchor in the embodiment illustrated in FIG. 2 comprises also a first body 22, resting on the sea bottom or connected thereto by means not shown in detail and comprising a cylindrical part 23 for receiving the second body 24 which is through the universal joint 25 coupled to the column 26 the upper end of which is connected to the coupling arm 27 of the tanker 28. Said arm 27 is influenced by the buoyant body 29. The seaing elements are schematically indicated by 30 and the pump is indicated by 31.

In this embodiment the first body 22 comprises a number of upwardly directed guiding pins or columns 32, cooperating with sidewardly extending guiding means 33 of the second body 24. In this embodiment the guiding function and coupling function are therefore separated.

Figure 3:
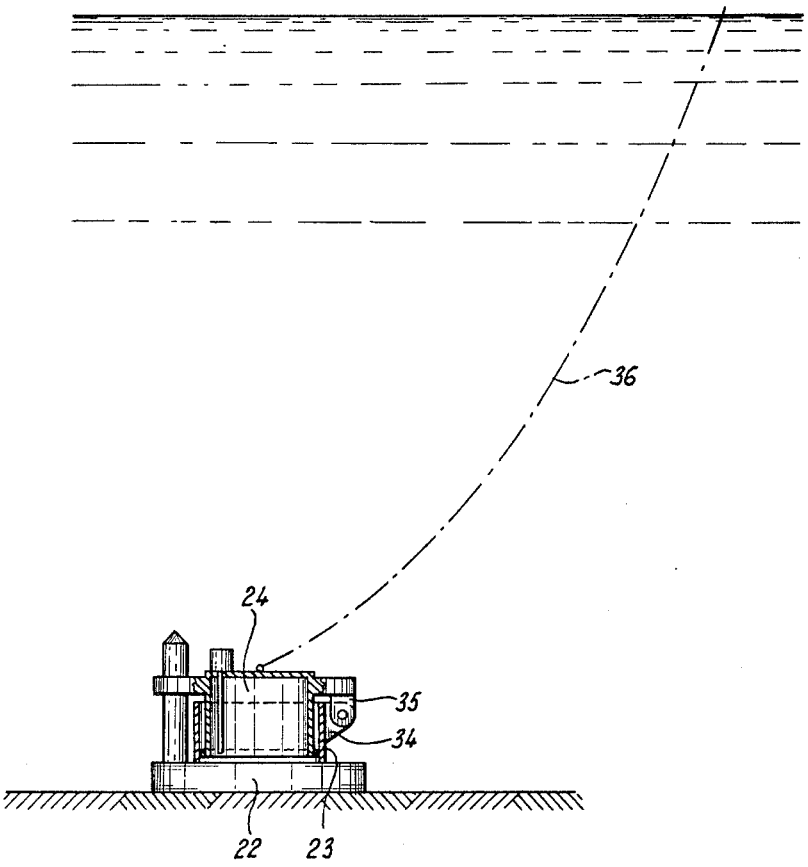
FIG. 3 illustrates a third embodiment.

The embodiment of FIG. 3 is very similar to the embodiment of FIG. 2 with the exception that the first body 22 comprises a section 34 of a locking device attached to the wall of the cylindrical part 23, which element cooperates with the part 35 of the locking device attached to the second body 24.

In this embodiment an anchor line 36 is illustrated instead of a column 26.

Figure 4:
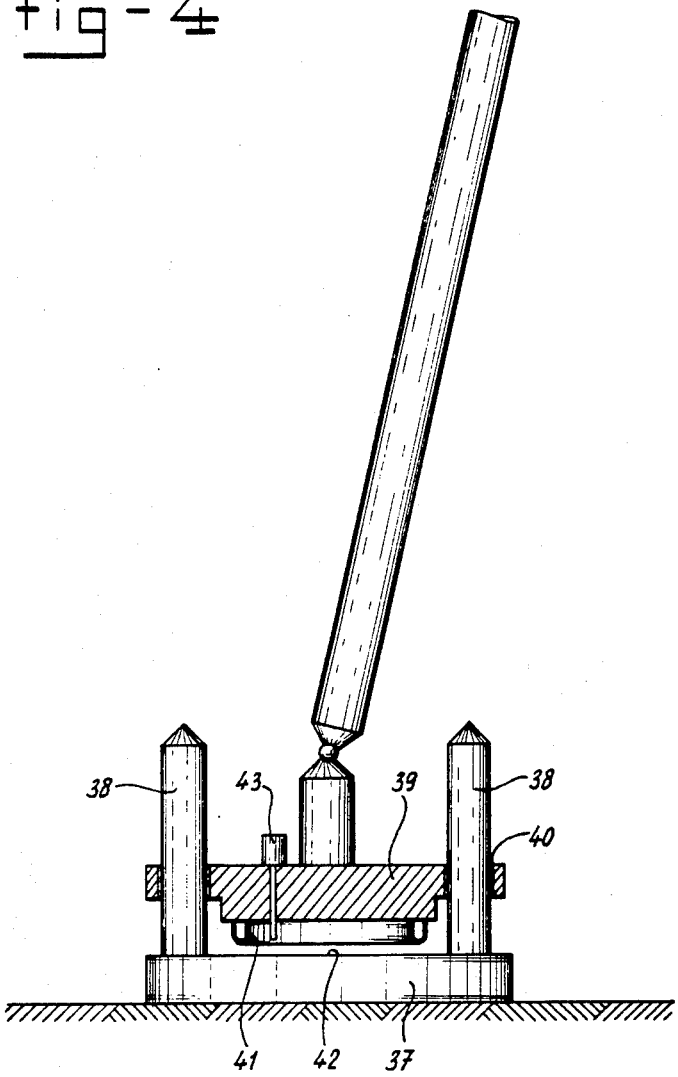
FIG. 4 illustrates a fourth embodiment.

In the embodiment of FIG. 4 the first body 37 comprises guiding pins 38 and the second body 39 is essentially embodied as a plate having guiding passages 40 for the pins 38. Said plate 39 carries a ring shaped sealing ridge 41. As soon as said ridge is positioned on the upper surface 42 of the first body 37 a space of relatively small volume is created from which by means of the pump 43 water can be removed resulting in an underpressure in said space.

It will be clear that instead of cylindrical underpressure chambers also underpressure chambers of other shapes are conceivable. Furthermore it will be clear that any type of anchoring means can be connected to the detachable second body. The guiding means will in general have a vertical axis, however it is also conceivable that the central axis is not exactly vertical.

Figure 5:
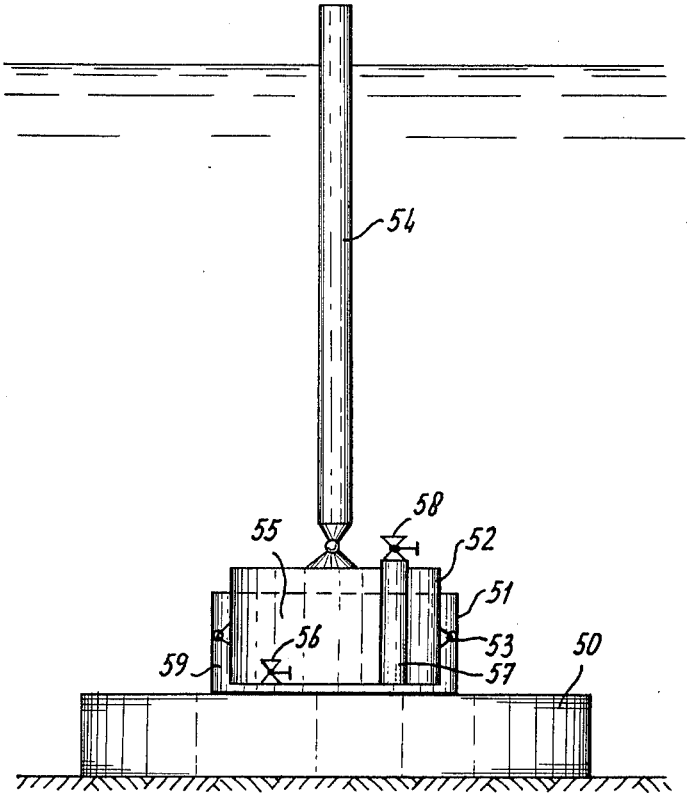
FIG. 5 illustrates a fifth embodiment.

The embodiment of FIG. 5 corresponds in essense with the embodiments illustrated in FIGS. 1 and 2. In this embodiment the base element, maintained on the sea bottom is indicated by 50 and on said base the upwardly open wall section 51 is installed into which the second body 52 is inserted and sealed by means of the sealing ring 53. The second body is positioned at the lower end of an upwardly directed column 54.

The second body 52 comprises a closed box having a hollow space 55. Said box comprises at the under side a valve 56 and a tube 57 runs through said space 55 to a valve 58 at the upper side.

The space 55 can be filled with air under atmospheric pressure. If the body 52 is inserted into the body 51 then by opening the valve 56 water will enter from the space 59 between both bodies 51 and 52 into the inner space 55 with the result that the coupling is established.

For decoupling it is only necessary to open the valve 58 so that the pressure in the space between the bodies 51 and 52 is brought back to the value it had before so that the body 52 can be removed upwardly out of the body 51.

We claim:

1. In an anchor for connecting or attaching a buoyant device, said anchor comprising a first body which is anchored on the ocean floor, and a second body which is connected to the buoyant device, said first and second bodies cooperating with each other such that between said bodies a sealed space is formed within which a pressure can be created which is lower than the water pressure outside said bodies; the improvement in which said first body has a vertical guide element for the second body, the guide element being a cylinder open at the top and closed at the bottom and the second body being a cylinder which by means of a circumferentially extending sealing ridge is guided and sealed within the first-mentioned cylinder.

2. Anchor as claimed in claim 1, wherein the guide element is formed by at least one vertical guide pin extending upwardly from the first body.

3. Anchor as claimed in claim 1, wherein the second body has a flat underface provided with an annular sealing ring which cooperates with a flat upper surface of the first body, said sealing ring being surrounded by a number of vertical guide pins, the space between said sealing ring and said upper surface and said underface defining said space within which the lower pressure can be generated.

4. Anchor as claimed in claim 1, wherein the second body is a closed hollow cylinder having a valve in its bottom.

* * * * *